United States Patent [19]

Haar

[11] Patent Number: 4,691,817

[45] Date of Patent: Sep. 8, 1987

[54] FEEDER FOR INTRODUCING AND FEEDING PLATES INTO A MACHINE TOOL

[75] Inventor: Thomas Haar, Halstenbek, Fed. Rep. of Germany

[73] Assignee: Alfons Haar Maschinenbau GmbH & Co. KG, Hamburg, Fed. Rep. of Germany

[21] Appl. No.: 777,938

[22] Filed: Sep. 19, 1985

[30] Foreign Application Priority Data

Oct. 13, 1984 [DE] Fed. Rep. of Germany ..... 3437642

[51] Int. Cl.[4] ..... B65G 25/04

[52] U.S. Cl. ..... 198/468.2; 198/341; 198/468.9; 198/586; 414/751; 414/225; 271/268

[58] Field of Search ..... 198/468.2, 468.01, 570, 198/341, 586, 737, 468.9; 414/751, 753, 20, 225, 226, 750; 271/85, 268

[56] References Cited

U.S. PATENT DOCUMENTS

| | | | |
|---|---|---|---|
| 2,723,022 | 11/1955 | Van Schie | 198/468.2 |
| 4,015,702 | 4/1977 | Bergling | 198/468.2 |
| 4,058,307 | 11/1977 | Bubley et al. | 198/468.2 |
| 4,305,331 | 12/1981 | Colapinto | 198/468.2 |
| 4,536,118 | 8/1985 | Baba | 414/750 |

FOREIGN PATENT DOCUMENTS

| | | | |
|---|---|---|---|
| 3241006 | 5/1984 | Fed. Rep. of Germany | 198/468.2 |

*Primary Examiner*—L. J. Paperner
*Assistant Examiner*—Lyle Kimms
*Attorney, Agent, or Firm*—Kinney & Lange

[57] ABSTRACT

A feeder for introducing and feeding plates into a machine tool, comprising a positioning station in which the plates are positioned one after the other with respect to orthogonal axes, a transfer section between the machine tool and the positioning station, two feeding carriages provided with grippers for seizing an edge of the plates and adapted to be adjusted along two parallel first guides between the positioning station and the machine tool by first feeding drives, with the two first guides guided by a second guide, the axis of which extends orthogonally with respect to the axis of the first guides, and adapted to be adjusted each by a second feeding drive of their own; and an automatic control controlling the feeding drives in such a manner that a plate is fed into a first processing position before the machine tool after the last working stroke for the preceding plate and before the machine tool performs a further working stroke.

2 Claims, 2 Drawing Figures

CONTROL
X
Y

FEEDER FOR INTRODUCING AND FEEDING PLATES INTO A MACHINE TOOL

The invention relates to a feeder for introducing and feeding plates into a machine tool, comprising a feeding carriage for seizing an edge of the plates and adapted to be adjusted along a first guide by means of a first feeder drive, a second guide the axis of which extends orthogonally with respect to the first guide and along which the first guide is adjustable by means of a second feeder drive, a positioning station in which the plates are positioned one after the other with respect to the orthogonal axes, a section of transfer between the machine tool and the positioning station, and an automatic control means sensing the working strokes of the machine tool and controlling the feeder drives in synchronism with the working strokes. Such a device is known (U.S. Pat. No. 4,382,395 or German utility model No. 83 18 201). It serves to supply plates, consisting of aluminum, for example, properly positioned, to a press which stamps from the plate a predetermined number of blanks. For this purpose, the plate is clamped in a feeder and moved between the stamping tools. The movement normally is along two orthogonal axes because, for the purpose of a favourable exploitation of the material, an offset pitch is selected.

In the case of the known device the feeding carriage is adapted to be moved along the first guide with the aid of a spindle drive. The first guide is adapted to be moved along the second guide with the aid of another spindle drive. The feeding carriage comprises two gripping tongs which seize the plate by the rear edge thereof and feed it step by step in the machine tool. This feeding movement is coupled to the movement of the machine tool such as a stamp, for example, in such a manner that the adjustment takes place within a period of time in which, during the return stroke and the working stroke, the tool is outside the working plane. Upon completion of a working cycle for one plate the feeding carriage returns to a starting position in which it will seize the next sheet metal plate. This sheet metal plate has been advanced in a properly positioned condition from a positioning station into the loading position by means of a loading carriage. In the known device, the loading means comprises a loading carriage having seizing means to seize the sheet metal plate, with the loading carriage passing through underneath the feeder in order to bring the sheet metal plate into the proper position. The loading means is designed in such a manner that the loading carriage will reach the loading position always at the same place, independently of the size of the sheet metal plate and the stamping diagram, so that the sheet metal plate too is assigned a predetermined starting position.

Because of the transfer of the individual plates into the feeder as described a certain period of time will lapse between the last working stroke for one sheet metal plate and the first working stroke for the next succeeding sheet metal plate during which the machine tool will perform several idle strokes. Such idle strokes, however are undesireable, because they reduce the production output.

It is therefore the object of the invention to provide a feeder for introducing and feeding plates into a machine tool, in which the plates may be processed without any periods of idle running of the machine tool. This object is attained in accordance with the invention in that two parallel first guides extend between the positioning station and the machine tool each guiding a feeding carriage provided with a gripping means and each comprising a first feeding drive; that both first guides are guided by the second guide and are each adjustable by a second feeding drive of their own; and in that the control means controls the feeding drives appertaining to the feeding carriages in such a manner that the plate will have been advanced into the first processing station in the machine tool before the machine tool after having performed the last working stroke for the preceding plate performs another working stroke.

For the device according to the invention a loading means is not necessary. While a first feeding carriage feeds a plate in the machine tool, the second loading carriage can fetch the next plate from the positioning station, in order to advance it in the machine tool, as soon as the preceding plate has been finished, for instance, when all the blanks have been blanked out. As the feeding drives for a respective carriage, of course, must be synchronized with the movement of the machine tool, it is also readily possible, perhaps with the aid of suitable numerical controls, to bring the succeeding sheet metal plate into the first position of processing, after the last working stroke on the preceding plate has been completed. As the stroke frequency is constant, and known, the loading carriage may be controlled in such a manner that it conveys the plate from the positioning station into the first processing station at the proper time, after the last working stroke has been completed and before the new working stroke is performed. According to one embodiment of the invention provision is made for this purpose for the control means to be designed in such a manner that the feeding carriage feeds the plate in the transfer section synchronously following the feeding movement of the preceding plate in the other feeding carriage. This may be carried out in such a manner that the plate present in the waiting position is approached very closely to the processed plate, for instance, within a distance of 1 mm, and the plate present in the position of readiness follows all the movements of the plate in the machine tool, so that the orientation and the distance of the plates with respect to each other will always be maintained.

As opposed to the known feeder the invention comprises four axes. A particular transfer means such as perhaps in the form of a loading carriage or the like is dispensed with. The novel construction makes possible, in comparison with the known device, the elimination of any changing times, i.e., each stroke of the machine tool is a working stroke. As compared with the known devices, an increase in production is obtained thereby of up to 30%.

So that the loading carriages of the device according to the invention will not mutually obstruct each other, the parallel first guides are extending in a direction coinciding with the direction in which the plates are moved out of the positioning station in the direction towards the machine tool. Upon completion of the processing of a plate in the machine tool, the appertaining first guide of the tool carriage may move the latter out of the range of collision with the plate approached by the other loading carriage, when it is moved towards the positioning station. A relative height adjustment as is required with the known device with respect to the feeding and loading carriage, is dispensed with.

The invention will be explained in the following in more detail by way of the drawings.

Figures 1, 2:
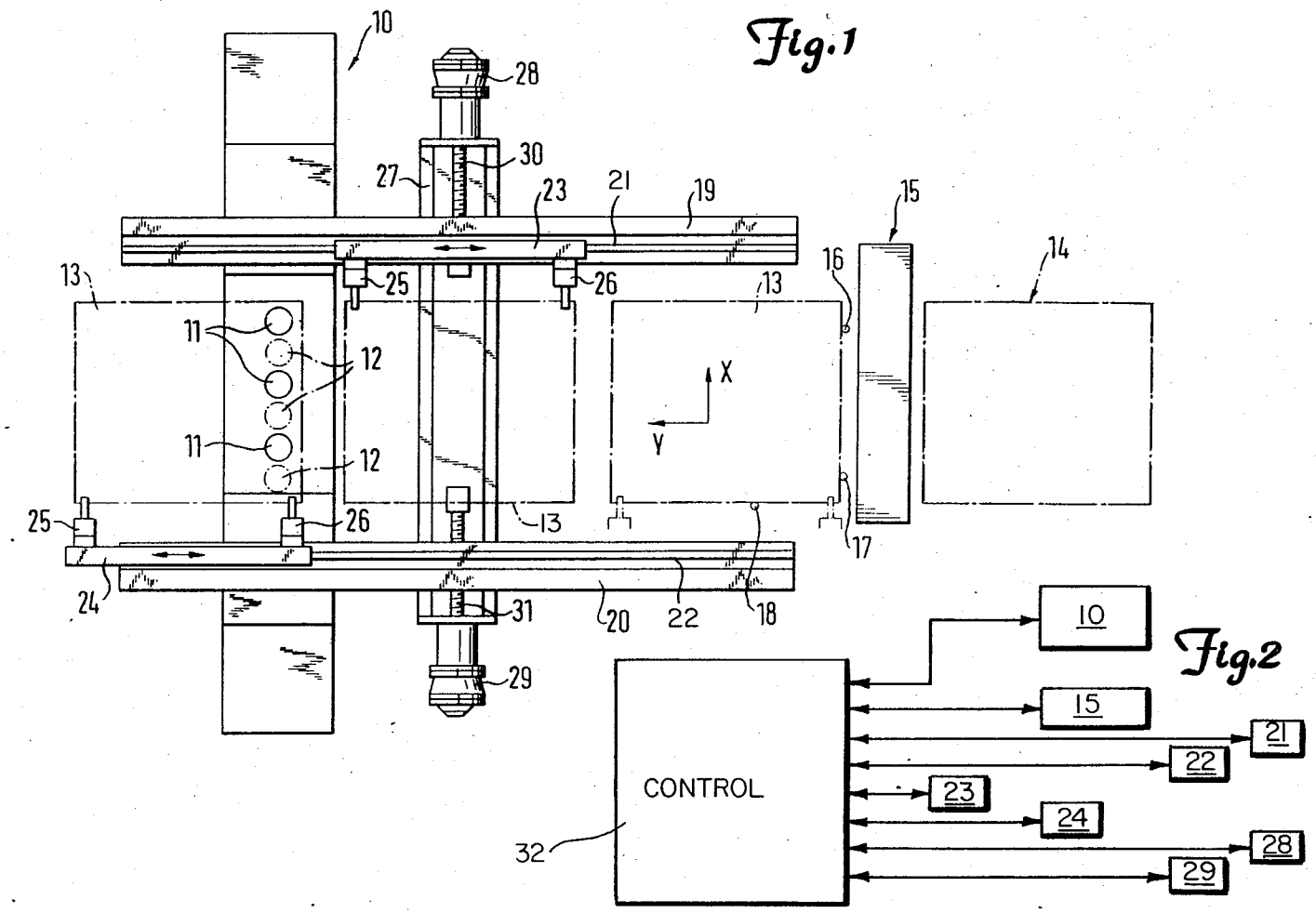
FIG. 1 shows a top plan view of a feeder according to the invention.
FIG. 2 is a schematic showing of the operational control system of the present invention.

Prior to enlarging in more detail on the individual representations shown in the drawings, it has to be stated that each of the features described is of inventively essential significance by itself or in connection with features of the claims.

A punch 10, the upper portion of which has been omitted in the interest of a clearer representation, comprises three punching tools which are indicated by thick solid lines 11. They serve for punching out circular blanks 12 from a sheet metal plate 13 shown in dash-dotted lines. The punch 10 is of a known design and is not going to be explained in any more detail. The necessary ejector means is also not shown.

Situated in an introduction device 14 is a stack of sheet metal plates which is lifted step by step with the aid of a lifting device (not shown). The respective upper sheet metal plate is pushed into the nip between the introduction rollers of a loading device 15 with the aid of several vertically adjustable suction cups (not shown). The sheet metal plate drops from above onto the machine table, not shown. Associated with the machine table are two first abutments 16, 17 and a second abutment 18. A positioning drive (not shown) places the plate in the positioning station against the abutments 16 to 18, in order to bring it into a predetermined position with respect to predetermined X and Y coordinates. Such a device is known, for example, from my U.S. Pat. No. 4,382,395, which is incorporated by reference herein.

Extending in the Y direction are two relatively long guides 19, 20, having first feeding drives 21, 22 about in the center thereof. The guides support feeding carriages 23 and 24, respectively, each comprising two gripping tongs 25, 26. The guides extend from the positioning station as far as the punch 10 and slightly beyond it, as will be seen from FIG. 1.

A third guide 27 is arranged stationarily and supports second feeding drives 28, 29 at its opposite ends. The feeding drives 28, 29 such as disk type motors, for example, drive adjusting spindles 30, 31. The third guide 27 supports the guides 19, 20 approximately centrally for adjustment in the X direction. For adjusting the feeding carriages 23, 24, various means may be imagined for the first feeding drives 21, 22, for instance, via spindles, cable lines, belts and the like.

A preferably numerical control 32 is operably connected to and controls the individual drives and operational runoffs of the feeder completely automatically (see FIG. 2).

The device as described operates as follows:

As soon as the positioning station is empty, a sheet metal plate is conveyed onto the working table by the means of introduction (loading device 15), and the sheet metal plate is brought into a predetermined starting position with the aid of the positioning drive and the abutments 16 to 18. The gripping tongs 25, 26 of the loading carriage 24 have seized a sheet metal plate 13 by the left-hand edge thereof (looking in the Y direction in FIG. 1) and are moving the plate step by step through the punch 10 along the X and Y axes, said punch punching blanks 12 one after the other from the plate 13. During this process step the carriage 23 had already been driven into the positioning station, in order to seize a positioned plate by the right-hand edge thereof with the aid of its tongs 25, 26. It goes without saying that during the reception of the plate 13 in the positioning station by the tongs 25, 26 the position thereof and the position of the carriage 23, respectively, must be defined. The carriage 23 guides the plate as received to a position of readiness near the processed plate (to position as shown by the middle plate of the three dashed-dotted plates in FIG. 1). At the same time, the first feeding drives 21, 22 are controlled in such a manner that the plate disposed in the position of readiness synchronously follows the movements of the foremost plate 13 in the punch 10. At the moment when the punch 10 has performed the last working stroke and the tools are in the process of performing the return stroke, the feeding carriage 23 runs the plate that has been received into a first processing position. At the same time, the second feeding drive 29 runs the feeding carriage 24 out of the tool region together with the used-up plate. The feeding carriage 24 then subsequently returns with its second feeding guide 29 retracted, so as not to have its tongs 25, 26 bumping against the new plate in the positioning station; the accommodation of a new plate is indicated in dash-dotted lines.

So that a synchronization of the feed of the plates by means of the feeding carriage 23, 24 and the movement of the punch 10 may be effected, a sensor (not shown) has to be provided to detect the runoff of their movements. This may be effected through sensing the rotation of the crankshaft of the punch 10 (Z axis), for example. The feeding cycle of the plate 13 in the punch 10 is derived from the rotation of the crankshaft. It also determines at what point of time the new plate must be in the first position of processing so that the punching out of the new plate may commence without any idle strokes. As the sheet metal plates are received by the feeding carriages 23 or 24 in the positioning station exactly positioned and in a predetermined position, the distances travelled from the positioning station as far as the first processing station in the punch are also fixed. The numerical control 32, therefore, may control any feeding movement from the positioning station as far as the punch (see FIG. 2).

As an alternative to the synchronized follow-up running of the new plate as described, the new plate may also first remain in the positioning station and the associated feeding carriage be controlled in such a manner that the proper moment of starting from the positioning station is calculated and the plate is run directly into the first position of processing.

Although the present invention has been described with reference to preferred embodiments, workers skilled in the art will recognize that changes may be made in form and detail without departing from the spirit and scope of the invention.

I claim:

1. A feeder for introducing and feeding plates into a machine tool, comprising a feeding carriage provided with a gripping means for seizing an edge of the plates, said carriage is reciprocated by means of a first feeding drive along a first guide, a second guide the axis of which extends orthogonally with respect to the first guide and along which the first guide is adjustable by means of a second feeding drive, a positioning station in which the plates are positioned one after the other with respect to the orthogonal axes, a transfer section between the machine tool and the positioning station, and an automatic control means sensing the working strokes of the machine tool and controlling the feeding drives in synchronism with the movement of the machine tool, a second first guide parallel to said other first guide extends between the positioning station and the machine tool (10) guiding a respective feeding carriage (23, 24) provided with a gripping means (25, 26), and a respective first feeding drive (21, 22), and the two first guides (19, 20) are guided by the second guide (27) and are adapted to be adjusted relative to each other by said second feeding drive means (28, 29) and the control means (32) controls the first feeding drive means (21, 22) belonging to each feeding carriage (23, 24) in such a manner that the plate (13) is fed into a first processing position adjacent the machine tool (10) after the last working stroke for a preceding plate (13) and before the machine tool (10) performs a further working stroke.

2. A feeder according to claim 1, characterized in that the control means (32) is designed in such a manner that one of the feeding carriages (23, 24) runs a plate (13) in the transfer section in synchronism with the feeding movement of the preceding plate (13) in the other feeding carriage (23, 24).

* * * * *